United States Patent [19]

Cheek

[11] 4,011,987

[45] Mar. 15, 1977

[54] AIRCRAFT DESCENT PROFILE CALCULATOR

[76] Inventor: Frank L. Cheek, 1 Cedar Mountain Trail, Suches, Ga. 30572

[22] Filed: Jan. 22, 1976

[21] Appl. No.: 651,553

[52] U.S. Cl. ..... 235/88 N; 235/78 N; 235/61 NV

[51] Int. Cl.[2] ..... G06C 3/00

[58] Field of Search ..... 235/88 N, 78 N, 61 NV

[56] References Cited

UNITED STATES PATENTS

| | | | |
|---|---|---|---|
| 3,255,961 | 6/1966 | Cumberpatch | 235/78 N |
| 3,279,695 | 10/1966 | Krause | 235/78 N |
| 3,609,299 | 9/1971 | Wright | 235/78 N X |
| 3,693,873 | 9/1972 | Otte | 235/88 N |
| 3,825,180 | 7/1974 | Gallagher | 235/88 N X |
| 3,929,279 | 12/1975 | Dibley | 235/88 N |

*Primary Examiner*—Ulysses Weldon
*Attorney, Agent, or Firm*—B. J. Powell

[57] ABSTRACT

An aircraft descent calculator including a central member defining an outer annular dial face about the periphery thereof; an intermediate member defining an intermediate annular dial face about the periphery thereof rotatably mounted on the central member so that the intermediate dial face lies adjacent the inside of said outer dial face; and an inner member defining an inner annular dial face about the periphery thereof rotatably mounted on the intermediate member in juxtaposition with said intermediate dial face where each of the dial faces divided into equal angular spaces, where the intermediate dial face has aircraft altitude indicia recorded thereon increasing in prescribed altitude increments in a first direction around the intermediate dial face and where both the inner and outer dial faces have aircraft DME distance recorded thereon increasing in prescribed distance increments in opposite directions around the dial faces so that said dial faces can be manipulated to determine positions on a prescribed aircraft descent profile.

5 Claims, 5 Drawing Figures

AIRCRAFT DESCENT PROFILE CALCULATOR

BACKGROUND OF THE INVENTION

While the control over aircraft positions in and around airports has become highly sophistocated, the control over the descent of the aircraft as the aircraft is approaching the control area of the airport is still left primarily to the manual control of the pilot of the aircraft. Because this descent profile has been primarily a manual operation, difficulties have been encountered in the pilot arriving at the control point set by the airport either too fast or too slow and also overshooting or undershooting the control point set by the airport. When the aircraft misses the control point, it can still be manually corrected, however, the correction technique usually requires additional fuel consumption and/or is uncomfortable to the passengers onboard the aircraft. The manual correction at the end of the descent around the control point set by the airport has resulted in a higher cost of operating the aircraft because of this wasted fuel. Due to the recent escalation in aircraft fuel costs, the cost of this wasted fuel has become significant and aircraft operators are seeking to minimize the amount of wasted fuel. Various efforts have been made to provide the pilot with the necessary information to arrive at the control point set by the airport to reduce the likelihood of the control point being missed at the end of descent. The major problem with these prior techniques is that the flexibility of such techniques is limited therefore requiring a lot of effort on the part of the pilots to use such techniques. This reduces the pilot's concentration on the actual flying of the aircraft which creates a safety hazard.

SUMMARY OF THE INVENTION

The invention disclosed herein overcomes these and other problems and disadvantages associated with prior art aircraft descent techniques by providing an extremely simple and reliable technique for controlling the descent profile of the aircraft while at the same time being extremely flexible so that the control of the aircraft can be determined using a single device. The device of the invention allows the descent profile of the aircraft to be determined whether the aircraft is moving toward a VOR/DME station (i.e. VHF Omnidirectional Range/Distance Measuring Equipment station used in conventional aircraft guidance), moving away from a VOR/DME station, or both. Further, the progress along the descent profile can be easily checked during the actual descent.

The apparatus of the invention includes a descent profile calculation device comprising at least three disc-shaped members of different diameters rotatable about a common axis in juxtaposition with each other so that the outer edge of the intermediate member projects beyond the edge of the inner member and the outer edge of the outer member projects beyond the edge of the intermediate member. The outer edge of each of the disc members is divided into equal angular spaces so that a space on each of the disc members is alignable with a space on the adjacent disc member. The altitude indicia is recorded in the spaces on the intermediate disc member, approaching DME distance indicia is recorded on the outer disc member, and leaving DME distance indicia is recorded on the inner disc member. The relationship between the altitude indicia in adjacent spaces on the intermediate disc member compared to the DME distance indicia on the inner and outer disc members is selected to provide a known descent profile. The relationship between adjacent spaces on the inner and outer disc members is the same and absolute value but opposite in sense. The outer disc member may be adjusted with respect to the intermediate disc member to determine the descent profile while the aircraft is approaching the VOR/DME station and the inner disc member may be adjusted with respect to the intermediate disc member to provide the descent profile with respect to the VOR/DME station as the aircraft is leaving the VOR/DME station.

These and other features and advantages of the invention disclosed herein will become more apparent upon consideration of the following specification and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
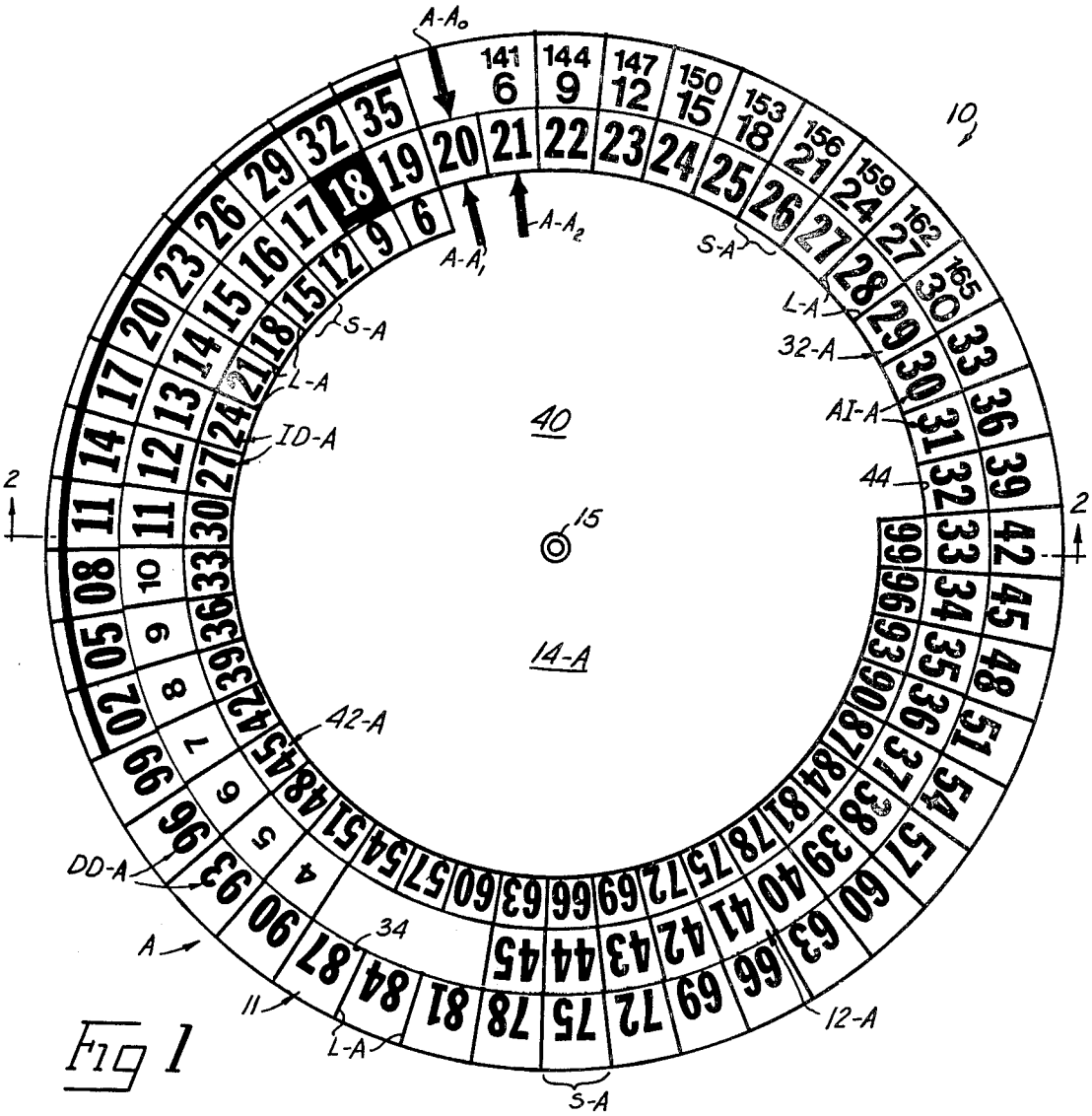
FIG. 1 is a side elevational view of one side of the apparatus of the invention.
Figure 2:
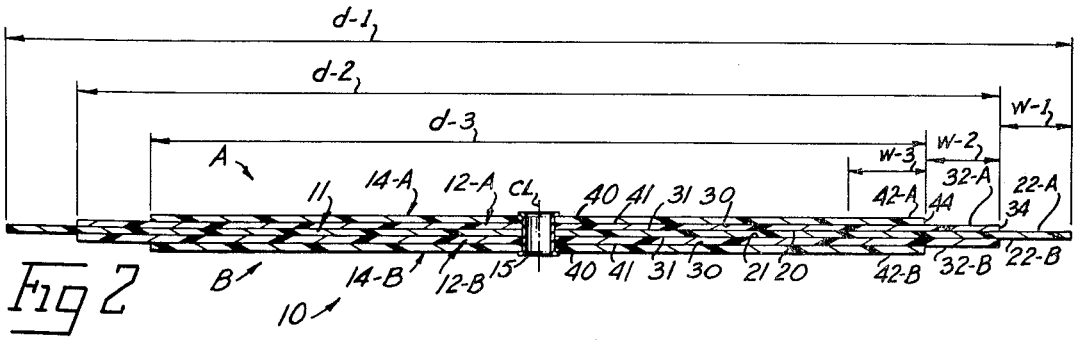
FIG. 2 is a transverse cross-sectional view taken along line 2—2 in FIG. 1.
Figure 3:
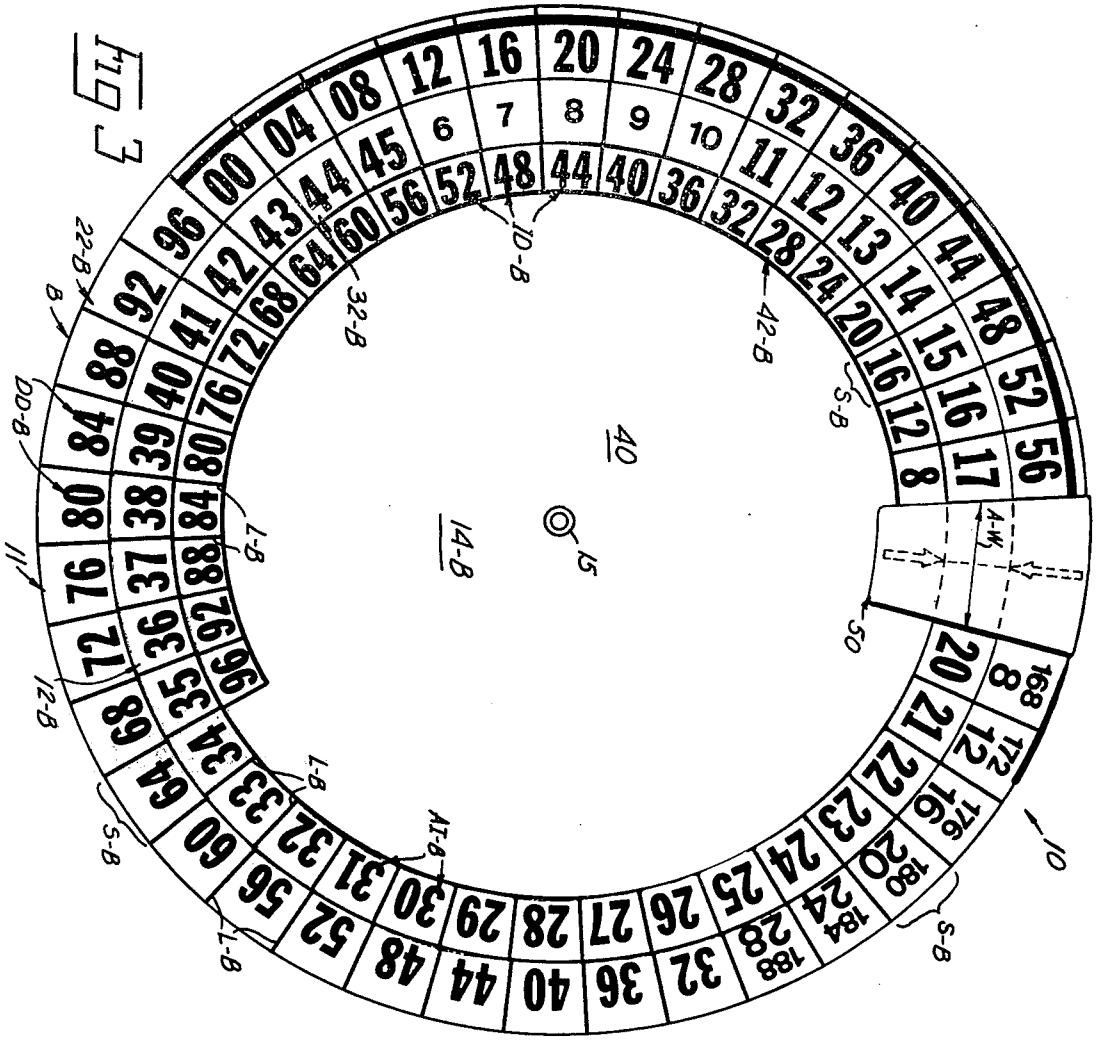
FIG. 3 is a side elevational view of the opposite side of the apparatus of the invention.

Referring to FIGS. 1–3, it will be seen that the descent calculator 10 has one side A with a first descent profile and the opposite side B with a second descent profile. The calculator 10 has a central disc-shaped member 11 which is used with both side of the calculator. Each side of the calculator has an intermediate disc-shaped member 12 and an inner disc-shaped member 14. To distinguish between sides of the calculator 10, the intermediate members 12 have been further designated 12-A and 12-B and inner members designated 14-A and 14-B. Since the opposite sides of the calculator 10 are made the same, only side A will be described in detail and similar reference numbers will be applied to side B. The central member 11, intermediate members 12-A and 12-A, and inner members 14-A and 14-B are maintained in juxtaposition and rotatable about a common axis AX by an eyelet or rivet 15.

The central member 10 is a relatively thin circular member with opposed parallel circular surfaces 20 and 21 of diameter *d*-1. Surface 20 faces side A and surface 21 faces side B. The intermediate member 12-A overlies surface 20. Intemediate member 12-A is also a relatively thin circular member with opposed parallel circular surfaces 30 and 31 of diamter *d*-2 less than diameter *d*-1 so that an outer annular dial face 22-A of width w-1 on surface 20 of member 11 is left exposed about the outer peripherial edge 34 of intermediate member 12-A. The surface 31 of intermediate member 12-A is in juxtaposition with the surface 20 on central member 11. The inner member 14-A overlies surface 30 of intermediate member 12-A. Inner member 14-A is also a thin circular member with opposed parallel circular surfaces 40 and 41 of diameter d-3 less than diameter d-2 so that an intermediate annular dial face 32-A of width w-2 on surface 30 of intermediate member 12-A is left exposed about the outer peripheral edge 44 of inner member 14-A. The surface 41 of inner member 14-A is in juxtaposition with surface 30 on intermediate member 12-A. An inner annular dial face 42-A is then exposed immediately adjacent the outer peripheral edge 44 of inner member 14-A. Thus, it will be seen that the dial faces 22-A, 32-A and 42-A can be rotated with respect to each other about axis AX.

Side B of calculator 10 is provided with outer dial face 22-B on surface 21 of central member 11, is provided with intermediate dial face 32-B on surface 30 of intermediate member 12-B, and is provided with inner dial face 42-B on surface 40 on inner member 14-B. Thus, it will be seen that dial faces 22-B, 32-B and 42-B are also rotatable with respect to each other about axis AX similarly to side A.

The central member 11, intermediate members 12-A and 12-B, and inner members 14-A and 14-B are usually made out of similar materials. Materials such as cardboard, plastic or laminates have been found satisfactory.

As best seen in FIG. 1, the dial faces 22-A, 32-A, and 42-A are all divided into equal angular spaces spaces S-A by radially extending lines L-A so that each face 22-A, 32-A and 42-A have a plurality of spaces S-A by the lines L-A. Thus, spaces S-A on dial 22-A are alignable with spaces S-A on dial 32-A, and spaces S-A on dial 42-A are also alignable with spaces S-A on dial 32-A by aligning the line L-A on adjacent members 11, 12-A and/or 14-A.

Aircraft altitude indicia AI-A is recorded in the spaces S-A on intermediate dial face 32-A. Decreasing DME distance indicia DD-A is recorded in the spaces S-A on outer dial face 22-A. Increasing DME distance indicia ID-A is recorded in the spaces S-A on inner dial face 42-A. The altitude indicia AI-A is recorded on dial face 32-A in increments of 1000 feet between adjacent spaces S-A and increase in one direction around face 32-A, here shown as clockwise. The altitude indicia members shown are divided by 1000 for simplicity. The decreasing DME distance indicia DD-A and the increasing DME distance are both recorded in miles from the VOR/DME locating station. The increment between indicia DD-A or indicia ID-A in adjacent spaces S-A is determined by the desired rate of descent for the aircraft descent profile. While this increment may be varied, indicia DD-A or ID-A shown in FIG. 1 are for a descent profile of 1000 feet descent per 3 nautical miles where the increment is 3 nautical miles between adjacent spaces S-A for both dial face 22-A and 42-A. Because dial face 22-A indicates decreasing DME distance as the aircraft moves toward a VOR/DME station, the indicia DD-A on dial face 22-A indicates increases in the same direction (clockwise) around dial face 22-A as the altitude indicia AI-A increases around dial face 32-A. Because dial face 42-A indicates increasing DME distance as the aircraft moves away from a VOR/DME station, the indicia ID-A on dial face 42-A increases in the opposite direction (counter clockwise) around dial face 42-A from that in which the altitude indicia AI-A increases around the dial face 32-A.

Side B of the calculator 10 is best illustrated in FIG. 3. The dial faces 22-B, 32-B, and 42-B are all divided into equal angular spaces S-B by radially extending lines L-B so that each face 22-B, 32-B, and 42-B have a plurality of spaces S-B by the lines L-B. Thus, spaces S-B on dial 22-B are alignable with spaces S-B on dial 32-B, and spaces S-B on dial 42-B are also alignable with spaces S-B on dial 32-B by aligning the lines L-B on adjacent members 11, 12-B and/or 14-B.

Aircraft altitude indicia AI-B is recorded in the spaces S-B on intermediate dial face 32-B. Decreasing DME distance indicia DD-B is recorded in the spaces S-B on outer dial face 22-B. Increasing DME distance indicia ID-B is recorded in the spaces S-B on inner dial face 42-B. The altitude indicia AI-B is recorded on dial face 32-B in increments of 1000 feet between adjacent spaces S-B and increase in one direction around face 32-B, here shown as clockwise. The altitude indicia members shown are divided by 1000 for simplicity. The decreasing DME distance indicia DD-B and the increasing DME distance are both recorded in miles from the VOR/DME locating station. The increment between indicia DD-B or indicia ID-B in adjacent spaces S-B is determined by the desired rate of descent for the aircraft descent profile and is shown in FIG. 3 for a descent profile of 1000 feet descent per 4 nautical miles where the increment is 4 nautical miles between adjacent spaces S-B for both dial face 22-B and 42-B. Because dial face 22-B indicates decreasing DME distance as the aircraft moves toward a VOR/DME station, the indicia DD-B on dial face 22-B increases in the same direction (clockwise) around dial face 22-B as the altitude indicia AI-B increases around dial face 32-B. Because dial face 42-B indicates increasing DME distance as the aircraft moves away from a VOR/DME station, the indicia ID-B on dial face 42-B increases in the opposite direction (counter clockwise) around dial face 42-B from that in which the altitude indicia AI-B increases around dial face 32-B.

It will be noted that the space S-A on the inner dial face 42-A corresponding to 3 DME miles is provided with an alignment arrow A-A, and that the space S-A on the inner dial face 42-A corresponding to O DME miles is provided with an alignment arrow $A\text{-}A_2$. The space S-A on the outer dial face 22-A corresponding to 3 DME miles is provided with an alignment arrow $A\text{-}A_0$. The arrow $A\text{-}A_0$ on dial face 22-A will be radially aligned with arrow $A\text{-}A_1$ on dial face 42-A where the VOR/DME station cross-over point in the descent profile is at an altitude 20,000 feet or below as will become more apparent. On the other hand, arrow $A\text{-}A_0$ on dial face 2-A will be radially aligned with arrow $A\text{-}A_2$ on dial face 42-A if the VOR/DME station cross-over point is at an altitude of above 20,000 feet as will become more apparent. This approximately corrects the DME distance reading between dial faces 22-A and 42-A to compensate for the height of the aircraft at the cross-over point.

Because the angle of the descent profile on side B of the calculator 10 is less than that for side A, the alignment arrows A–B on side B of calculator 10 are located on the line L-B separating the spaces S-B corresponding to 0 and 4 DME miles on both inner dial face 42-B and outer dial face 22-B. This provides an approximate correction of the height of the aircraft at the VOR/DME station cross-over point.

Figure 4:
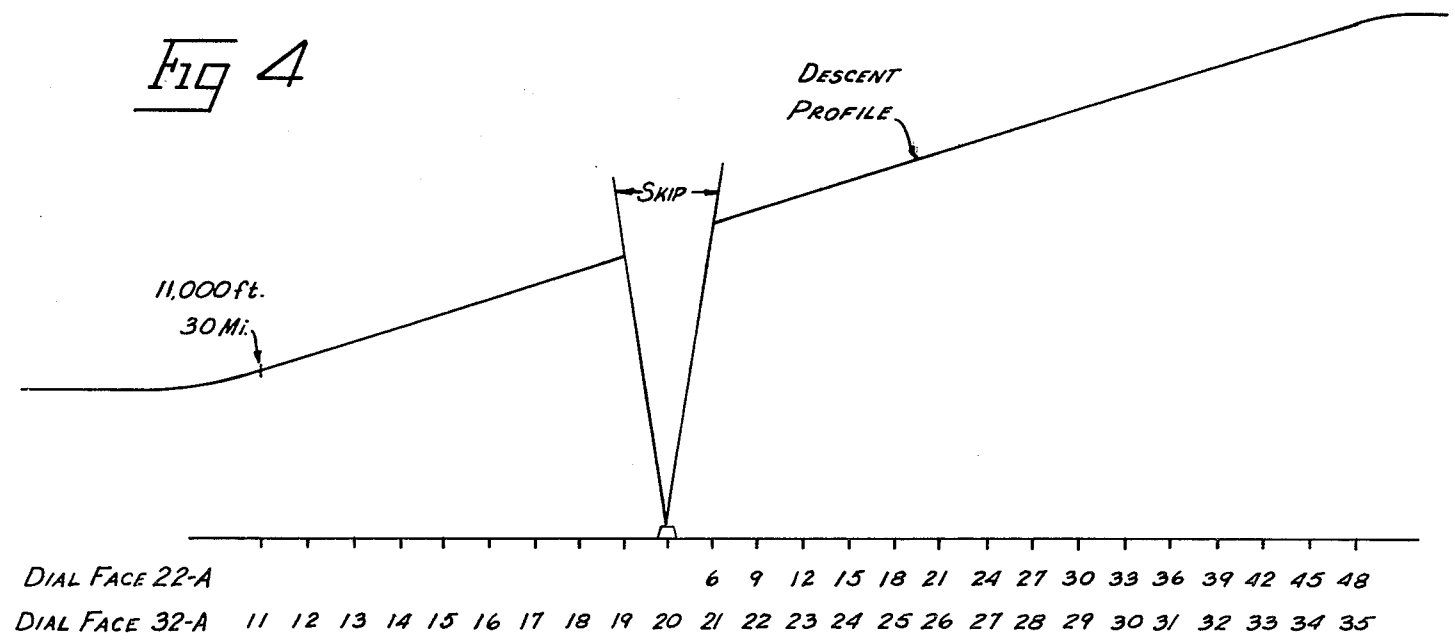
FIG. 4 is a chart illustrating the use of the invention.

The operation of calculator 10 can best be understood by reference to FIGS. 1 and 4. Assume that air traffic control has required the pilot of an aircraft to cross a point 30 nautical miles inboard from a VOR/DME station located between the airport and the approaching aircraft at an altitude of 11,000 feet and to level out thereafter. It will be appreciated that a transition space will be required after the aircraft has descended through this point.

Using side A of the calculator 10, he would align 30 on the inner dial face 42-A with 11 on the intermediate dial face 32-A as seen in FIG. 1. Because the aircraft is further from the airport than the VOR/DME station, the pilot then sees that he will cross-over the VOR/DME station at about 20,000 feet altitude and therefore sets the outer dial face 22-A so that the arrow $A\text{-}A_0$ on dial face 22-A is radially aligned with the arrow $A\text{-}A_1$ on the inner dial face 42-A. The descent profile is now established. To find the point where the pilot is to start the descent, he simply moves around the intermediate dial face 32-A until he finds his present cruising altitude. For instance, if the aircraft is cruising at 35,000 feet, the pilot finds 35 on dial face 32-A and sees that he should have started his descent when he is 48 nautical miles away from and approaching the VOR/DME station as shown on the outer dial face 22-A. The pilot may add a mile to the figure shown on dial 22-A to start the descent to insure a smooth transition. Thus, the pilot would start the descent at 49 nautical miles away from the VOR/DME station. As the pilot moves along the descent profile, he can monitor his descent progress at each 1,000 feet of descent so that any small corrections in altitude may be made to remain on the selected descent profile. The side B of calculator 10 would be used similarly. If the VOR/DME station does not lie between the aircraft and the airport, then it will be necessary to use only one of the dial faces 22-A or 42-A with the intermediate dial face 32-A.

Because the DME distance indicated in the aircraft is the actual distance between the aircraft and the station and not the effective ground distance between the aircraft and the station, the indicated DME distance will never be 0 at the cross-over point. This is the reason for the skip as the pilot transfers between the outer dial face 22-A or 22-B and the inner dial face 42-A or 42-B. Moreover, the indicated DME distance loses some of its accuracy as the aircraft moves over the VOR/DME station so that it is desirable to skip a certain section of the dial faces 22, 32, and 42 while the aircraft passes over the station. To assist in this matter, a clip 50 as seen in FIG. 3 may be provided which clips over that portion of the dials to prevent a reading being taken in this section. The clip 50 has an arcuate width AW such that the prescribed section of dials 22, 32, and 42 are covered as seen in FIG. 3. Clip 50 also serves to maintain the members 11, 12 and 14 in position.

Figure 5:
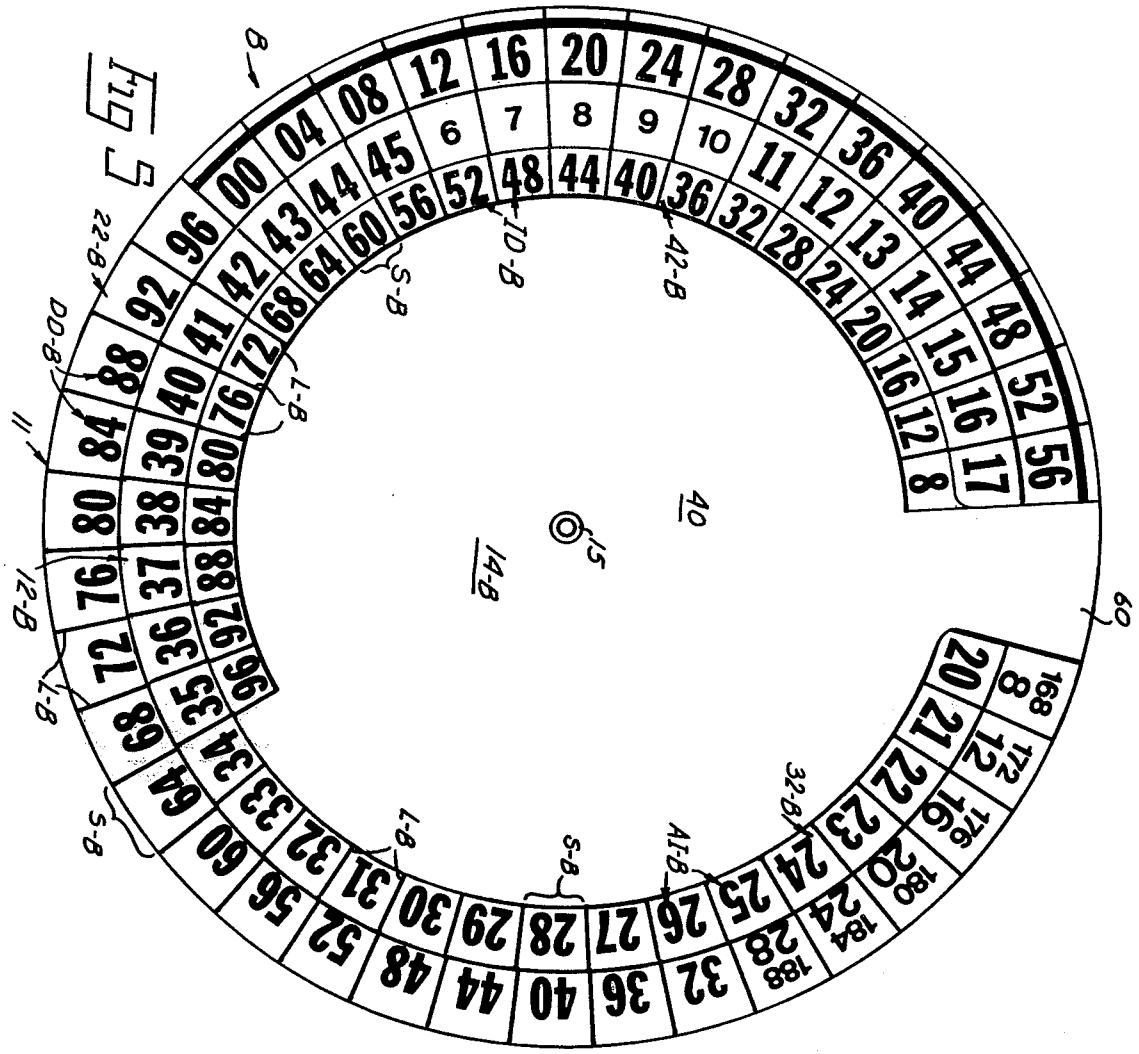
FIG. 5 is a view similar to FIG. 3 showing a modification of the invention.

Because the relationship between the dial faces 22 and 42 are generally fixed during a descent profile calculation, they may be fixed with respect to each other by an interconnecting strip 60, especially side B of the calculator as seen in FIG. 5. This allows the intermediate member 12-B to be rotated with respect to central member 11 and inner 14-B at the same time to reduce the requied manipulations to operate the calculator.

What is claimed is:

1. An aircraft descent calculator comprising:

a central member defining an outer annular dial face about the periphery thereof;

an intermediate member defining an intermediate annular dial face about the periphery thereof, said intermediate member rotatably mounted on said central member in juxtaposition with said central member so that said intermediate dial face lies adjacent the inside of said outer dial face and is rotatable with respect to said outer dial face about a common axis of rotation coinciding with the center of said outer dial face;

an inner member defining an inner annular dial face about the periphery thereof, said inner dial member rotatably mounted on said intermediate member in juxtaposition with said intermediate dial face about said common axis of rotation; and, each of said dial faces divided into equal angular spaces so that said angular spaces on each of said dial faces is selectively alignable with the angular spaces on the adjacent dial face, said intermediate dial face having aircraft altitude indicia recorded thereon increasing in said prescribed altitude increments in a first direction around said intermediate dial face, said outer dial face having aircraft DME (distance measuring equipment) distance recorded thereon increasing in prescribed distance increments in one direction around said outer dial face, and said inner dial face having aircraft DME distance recorded thereon increasing in said prescribed distance increments in the direction around said inner dial opposite to said one direction around said outer dial face so that said dial face can be manipulated to deteremine positions on a prescribed aircraft descent profile.

2. The aircraft descent calculator of claim 1 wherein said aircraft DME (Distance Measuring Equipment) distance recorded on said outer dial face increases in the same direction as said first direction so that said outer dial face represents aircraft DME distance as the aircraft moves toward a VOR/DME (VHF Omnidirectional Range/Distance Measuring Equipment) station and said inner dial face represents aircraft DME distance as the aircraft moves away from a VOR/DME station.

3. The aircraft descent calculator of claim 1 further including connection means for maintaining a relatively fixed rotational relationship between said inner and outer dial faces.

4. The aircraft descent calculator of claim 1 wherein said central member further defines a second outer annular dial face about the periphery thereof opposite said first mentioned outer dial face and further including:

a second intermediate member defining a second intermediate annular dial face about the periphery thereof, said second intermediate member rotatably mounted on said central member is juxtaposition with said central member so that said second intermediate dial face lies adjacent the inside of said second outer dial face and is rotatable with respect to said second outer dial face about said common axis of rotation;

a second inner member defining a second inner annular dial face about the periphery thereof, said second inner dial member rotatably mounted on said second intermediate member in juxtaposition with said second intermediate dial face about said common axis of rotation; and, each of said second dial faces divided into equal angular spaces so that said angular spaces on each of said second dial faces is selectively alignable with the angular spaces on the adjacent second dial face, said second intermediate dial face having aircraft altitude indicia recorded thereon increasing in said prescribed altitude increments in a first direction around said second intermediate dial face, said second outer dial face having aircraft DME (Distance Measuring Equipment) distance recorded thereon increasing in second prescribed distance increments in one direction around said second outer dial face, and said second inner dial face having aircraft DME distance recorded thereon increasing in said second prescribed distance increments in the direction around said second inner dial face opposite to said one direction around said second outer dial face so that said second dial face can be manipulated to determine positions on a second prescribed aircraft descent profile.

5. The aircraft descent calculator of claim 1 wherein the relationship between said prescribed distance increments on inner and outer dial faces and said prescribed altitude increments on said intermediate dial face is such to define an aircraft descent profile of 1,000 feet altitude per 3 nautical miles.

* * * * *